US009784499B2

(12) United States Patent
Herman et al.

(10) Patent No.: US 9,784,499 B2
(45) Date of Patent: Oct. 10, 2017

(54) APPLIANCE FOR DRYING ARTICLES

(71) Applicant: Whirlpool Corporation, Benton Harbor, MI (US)

(72) Inventors: Mark L. Herman, Saint Joseph, MI (US); Garry L. Peterman, Stevensville, MI (US); Arun Rajendran, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 461 days.

(21) Appl. No.: 13/974,092

(22) Filed: Aug. 23, 2013

(65) Prior Publication Data

US 2015/0052775 A1 Feb. 26, 2015

(51) Int. Cl.

| | |
|---|---|
| ***F26B 3/34*** | (2006.01) |
| ***D06F 58/10*** | (2006.01) |
| ***D06F 58/26*** | (2006.01) |
| ***H05B 6/54*** | (2006.01) |
| ***H05B 6/62*** | (2006.01) |
| ***F26B 3/347*** | (2006.01) |

(52) U.S. Cl.

CPC ..... *F26B 3/34* (2013.01); *D06F 58/10* (2013.01); *D06F 58/266* (2013.01); *F26B 3/347* (2013.01); *H05B 6/54* (2013.01); *H05B 6/62* (2013.01)

(58) Field of Classification Search

CPC ..... D06F 58/266; F26B 3/34; H05B 6/54; H05B 6/62

See application file for complete search history.

(56) References Cited

U.S. PATENT DOCUMENTS

| | | | | |
|---|---|---|---|---|
| 1,503,224 A * | 7/1924 | Blaine | B41F 23/0486 | 101/424.1 |
| 1,871,269 A * | 8/1932 | Hobrock | F26B 3/34 | 204/551 |
| 2,112,418 A * | 3/1938 | Hart, Jr. | F26B 3/34 | 134/1 |
| 2,212,522 A * | 8/1940 | Hart, Jr. | C14B 1/26 | 12/142 F |

(Continued)

FOREIGN PATENT DOCUMENTS

| | | |
|---|---|---|
| EP | 1753265 A1 | 2/2007 |
| GB | 601855 A | 5/1948 |

OTHER PUBLICATIONS

"British help american wounded: Rehabilitation and treatment, UK, 1944", Ministry of information second world war official collection.*

(Continued)

*Primary Examiner* — Kenneth Rinehart
*Assistant Examiner* — Logan Jones

(57) ABSTRACT

A radio frequency (RF) laundry dryer includes, amongst other things, an RF generator, a drying surface and a Faraday cage enclosing the drying surface. The drying surface on which textiles are supported further includes an RF applicator having an anode and cathode coupled to the RF generator. At least a portion of the cathode substantially encompasses the anode to electrically shield the anode from the Faraday cage ensuring the formation of an e-field between the anode and cathode instead of the anode and the Faraday cage upon energizing the RF generator.

8 Claims, 4 Drawing Sheets

(56) References Cited

U.S. PATENT DOCUMENTS 2,228,136 A * 1/1941 Hart, Jr. ..... A43D 25/20 12/142 F
2,276,996 A * 3/1942 Milinowski ..... A61N 1/06 331/68
2,511,839 A * 6/1950 Frye ..... D06F 58/26 219/774
2,542,589 A * 2/1951 Stanton ..... H05B 6/54 219/778
2,656,839 A * 10/1953 Howard ..... A61N 1/40 331/60
2,773,162 A * 12/1956 Christensen ..... B64D 15/12 219/203
3,161,480 A * 12/1964 Birch-Iensen ..... H05B 6/46 219/775
3,426,439 A * 2/1969 Ryman ..... H05B 6/788 219/752
3,652,816 A * 3/1972 Preston ..... H05B 6/78 219/773
3,701,875 A * 10/1972 Witsey ..... H05B 6/54 219/778
4,197,851 A * 4/1980 Fellus ..... A61N 1/40 219/748
4,296,299 A * 10/1981 Stottmann ..... H05B 6/62 219/771
4,365,622 A * 12/1982 Harrison ..... H05B 6/54 219/770
4,523,387 A * 6/1985 Mahan ..... D06F 58/02 219/741
4,638,571 A * 1/1987 Cook ..... F26B 13/104 219/770
5,838,111 A * 11/1998 Hayashi ..... H01J 37/32082 118/723 AN
6,812,445 B2 * 11/2004 Gorbold ..... H05B 6/54 219/764
7,883,609 B2 * 2/2011 Petrenko ..... B60S 1/026 204/242
8,499,472 B2 * 8/2013 Bari ..... D06F 58/16 219/211
8,839,527 B2 * 9/2014 Ben-Shmuel ..... D06F 58/266 34/255
8,943,705 B2 * 2/2015 Wisherd ..... 219/629
2004/0149734 A1 * 8/2004 Petrenko ..... B60S 1/026 219/538
2006/0289526 A1 * 12/2006 Takizaki ..... H05B 6/6402 219/746
2007/0045307 A1 * 3/2007 Tsui ..... D06F 58/266 219/775
2010/0115785 A1 * 5/2010 Ben-Shmuel ..... D06F 58/266 34/260
2011/0308101 A1 * 12/2011 Wisherd ..... D06F 58/26 34/255
2012/0291304 A1 * 11/2012 Wisherd ..... F26B 3/343 34/255
2013/0119055 A1 * 5/2013 Wohl ..... H05B 6/62 219/774
2013/0271811 A1 * 10/2013 Lam ..... E06B 9/24 359/266
2014/0325865 A1 * 11/2014 Wisherd ..... D06F 58/266 34/255

OTHER PUBLICATIONS

European Search Report for Corresponding EP14179021.2, Feb. 3, 2015.

* cited by examiner

APPLIANCE FOR DRYING ARTICLES

BACKGROUND OF THE INVENTION

Dielectric heating is the process in which a high-frequency alternating electric field heats a dielectric material, such as water molecules. At higher frequencies, this heating is caused by molecular dipole rotation within the dielectric material, while at lower frequencies in conductive fluids, other mechanisms such as ion-drag are more important in generating thermal energy.

In dielectric heating, microwave frequencies are typically applied for cooking food items and are considered undesirable for drying laundry articles because of the possible temporary runaway thermal effects random application of the waves in a traditional microwave. Radio frequencies and their corresponding controlled and contained e-field are typically used for drying of textiles.

When applying an RF electronic field (e-field) to a wet article, such as a clothing material, the e-field may cause the water molecules within the e-field to dielectrically heat, generating thermal energy that effects the rapid drying of the articles.

BRIEF DESCRIPTION OF THE INVENTION

One aspect of the invention is directed to a radio frequency (RF) laundry dryer. The RF laundry dryer includes an RF generator; a drying surface on which textiles are supported for drying and comprising an RF applicator having an anode and a cathode coupled to the RF generator; and a Faraday cage enclosing the drying surface; wherein at least a portion of the cathode substantially encompasses the anode to electrically shield the anode from the Faraday cage ensuring the formation of an e-field between the anode and cathode instead of the anode and the Faraday cage upon the energizing of the RF generator.

DESCRIPTION OF EMBODIMENTS OF THE INVENTION

While this description may be primarily directed toward a laundry drying machine, the invention may be applicable in any environment using a radio frequency (RF) signal application to dehydrate any wet article.

Figures 1, 2:
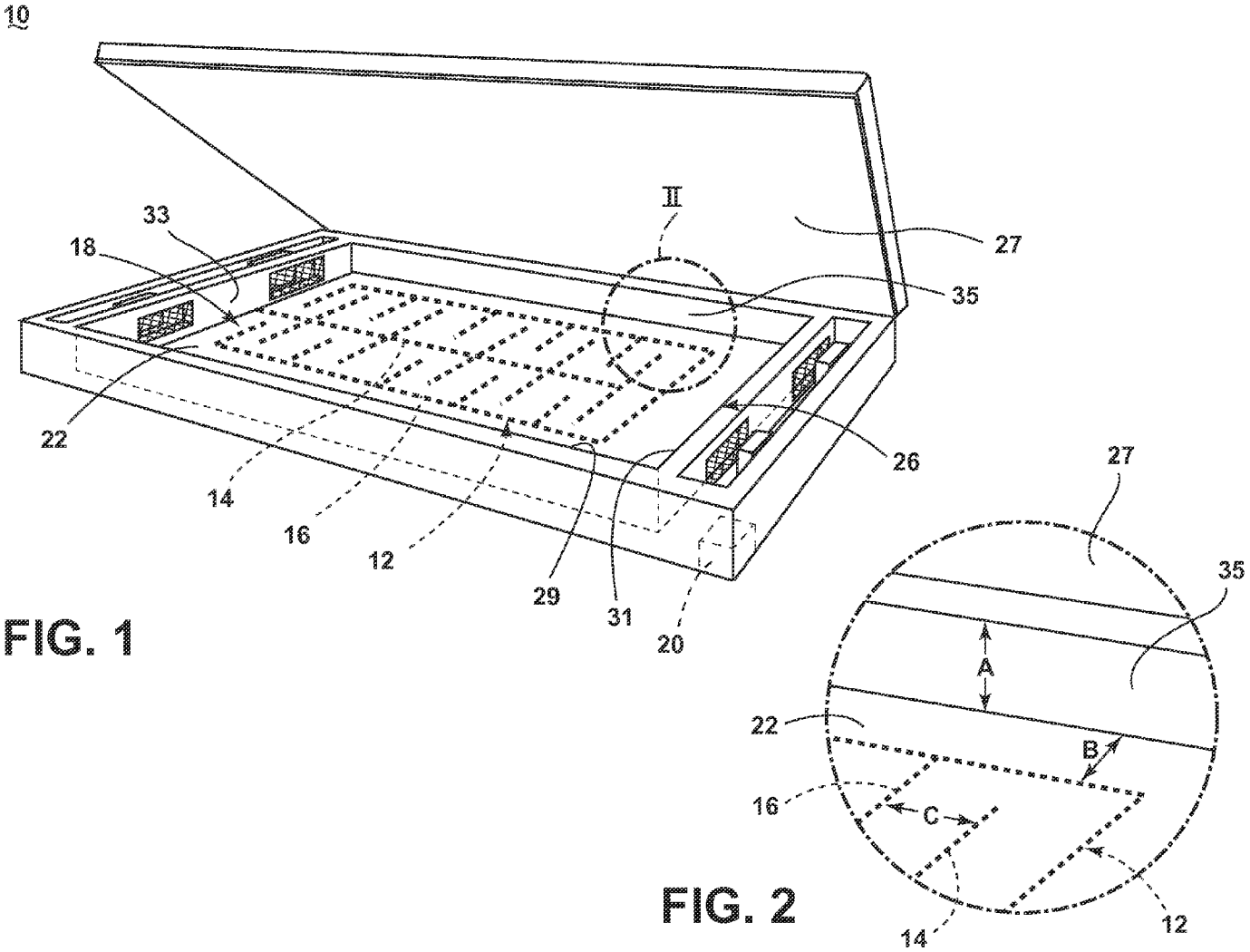
FIG. 1 is a schematic perspective view of the RF laundry dryer in accordance with the first embodiment of the invention.
FIG. 2 is a schematic perspective view of the RF dryer of FIG. 1 in a region of the drying surface where the anode and cathode elements are proximal to the Faraday cage.

As illustrated in FIG. 1, the RF laundry drying appliance 10 includes an RF applicator 12 supplied by an RF generator 20. The RF applicator 12 includes an anode element 14 and a cathode element 16 coupled to the RF generator 20 which, upon the energization of the RF generator 20, creates an e-field between the anode and cathode. A drying surface 22, on which laundry is supported for drying, is located relative to the RF applicator 12 such that the drying surface 22 lies within the e-field. A Faraday cage 26 encloses the drying surface 22.

The drying surface 22 may be in the form of a supporting body 18, such as a non-conductive bed, having an upper surface for receiving wet laundry and which forms the drying surface 22. Preferably, the drying surface 22 is a planar surface though other surfaces may be implemented.

A portion of the cathode element 16 may substantially encompass the anode element 14 to ensure, upon energizing of the RF generator 20, the formation of the e-field between the anode and cathode elements 14, 16 instead of between the anode element 14 and the Faraday cage 26.

The Faraday cage 26 may be a conductive material or a mesh of conductive material forming an enclosure that heavily attenuates or blocks transmission of radio waves of the e-field into or out of the enclosed volume. The enclosure of the Faraday cage 26 may be formed as the volume sealed off by a rectangular cuboid. The six rectangular faces of the cuboid may be formed as the four rigid walls 29, 31, 33, 35 lining the RF dryer 10, a bottom surface (not shown) and a top surface that is formed in the lid 27 of the RF dryer when the lid is in the closed position. Other geometrical configurations for the enclosure including, but not limited to, any convex polyhedron may be implemented and the example shown in FIG. 1 should not be considered limiting.

Referring now to FIG. 2, the placement of the faces that define the Faraday cage 26 relative to the RF applicator 12 elements such as the anode element 14 and a cathode element 16 may now be described. FIG. 2 shows a region designated as II in FIG. 1 of the drying surface where the anode and cathode elements are proximal to the Faraday cage. The space between the cathode element 16 and the Faraday cage 26 may be quantified both horizontally and vertically as the shortest distance between the cathode element 16 and the nearest face of the Faraday cage 26 in a respective plane. For example in FIG. 2, consider the shortest horizontal distance B from the cathode element 16 and the nearest of the conductive wall elements of the Faraday cage shown as 35 in FIG. 2. Also, in FIG. 2, due to the horizontally configured RF applicator 12 in the planar drying surface 22, the shortest vertical distance A for any element of the RF applicator 12 is the distance along the normal vector of the drying surface 22 from the RF applicator 12 to the closer of the lid 27 when closed or the bottom surface (not shown) of the RF dryer 10. The anode element 14 and the cathode element 16 may then be configured such that the spacing C between the anode and cathode elements 14, 16 is less than either the horizontal or vertical spacing A, B from the cathode element 16. In this way, the anode element 14 is spaced closer to the cathode element 16 than to the Faraday cage 26. Also, the planar drying surface 22 may be vertically spaced from the Faraday cage 26.

By controlling the spacing C of the anode element 14 and the cathode element 16 to be less than the spacing A, B of the cathode element 16 and the Faraday cage 26, the anode element 14 may be electrically shielded from the Faraday cage 26 with at least a portion of the cathode element 16.

Figure 3:
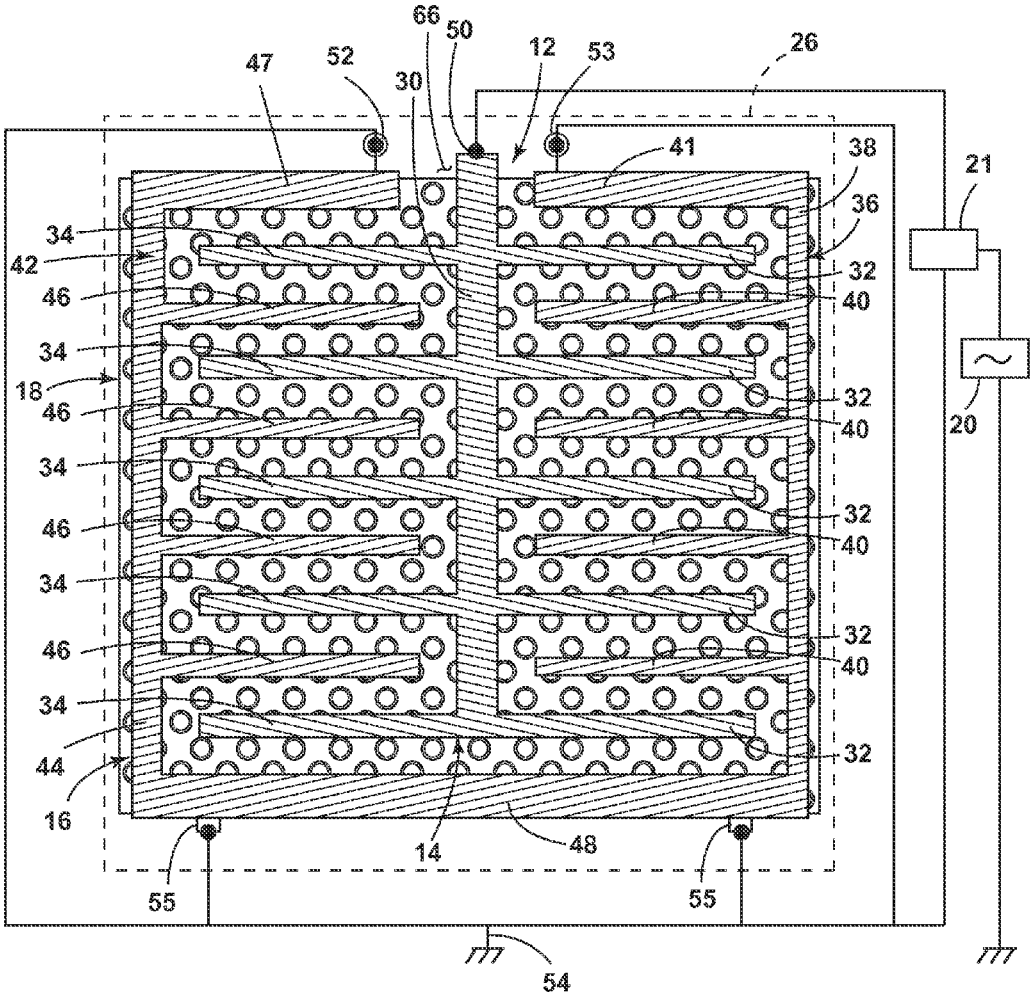
FIG. 3 is a schematic view of the electrical elements such as the anode and cathode elements of the RF applicator of the RF dryer of FIG. 1.

Referring to FIG. 3, the anode element 14 and the cathode element 16 each consist of a plurality of digits interdigitally arranged. The anode element 14 may further include at least one anode terminal 50 and a linear tree structure having a trunk 30 from which extends a first plurality of digits 32 and a second plurality of digits 34. The first and second plurality of digits 32, 34 may extend from opposite sides of the trunk 30 perpendicular to the length of the trunk 30. In a preferred embodiment of the anode element 14, each member of the first plurality of digits 32 has a one-to-one corresponding member of the second plurality of digits 34 that is coupled to the trunk 30 at the same location as the corresponding member of the second plurality of digits 34.

The cathode element 16 may further include at least one terminal 52, a first comb element 36 having a first trunk 38 from which extend a first plurality of digits 40 and a second comb element 42 having a second trunk 44 from which extend a second plurality of digits 46. The anode and cathode elements 14, 16 may be fixedly mounted to a supporting body 18 in such a way as to interdigitally arrange the first plurality of digits 32 of the anode element 14 and the first plurality of digits 40 of the first comb element 36 of the cathode element 16.

The anode and cathode elements 14, 16 may be fixedly mounted to the supporting body 18 in such a way as to interdigitally arrange the second plurality of digits 34 of the anode element 14 and the second plurality of digits 46 of the second comb element 42 of the cathode 16. Each of the conductive anode and cathode elements 14, 16 remain at least partially spaced from each other by a separating gap, or by non-conductive segments. The supporting body 18 may be made of any suitable low loss, fire retardant materials, or at least one layer of insulating materials that isolates the conductive anode and cathode elements 14, 16 and may also be formed with a series of perforations to allow for airflow through the anode and cathode elements. The supporting body 18 may also provide a rigid structure for the RF laundry dryer 10, or may be further supported by secondary structural elements, such as a frame or truss system. The anode and cathode elements 14, 16 may be fixedly mounted to the supporting body 18 by, for example, adhesion, fastener connections, or laminated layers. Alternative mounting techniques may be employed.

The anode and cathode elements 14, 16 are preferably arranged in a coplanar configuration. The first trunk element 38 of the cathode element 16 and the second trunk element 44 of the cathode element 16 will be in physical connection by way of a third interconnecting trunk element 48 that effectively wraps the first and second comb elements 36, 42 of the cathode element 16 around the anode element 14. In this way, the anode element 14 has multiple digits 32, 34 and the cathode element 16 encompasses the multiple digits 32, 34 of the anode element 14. The cathode trunk elements 38, 44, 48 and the digits 41, 47 proximal to the anode terminal 50 encompass the anode digits 32, 34. In a preferred embodiment of the invention, at least one of the digits of the cathode 16 encompasses the anode digits 32, 34. Additionally, the cathode element 16 has multiple digits 40, 46 with at least some of the anode digits 32, 34 and cathode digits 40, 46 being interdigitated.

The gap between the digits 41, 47 proximal to the anode terminal 50 form a space 66 in the cathode element 16. The trunk 30 of the anode element 14 from which the anode digits 32, 34 branch may pass through the space 66 in the cathode to connect to the terminal 50. At either side of the gap, the cathode element 14 may have a cathode terminal 52, 53 electrically coupled to ground 54.

The RF applicator 12 may be configured to generate an e-field within the radio frequency spectrum between the anode 14 and cathode 16 elements. The anode element 14 of the RF applicator 12 may be electrically coupled to an RF generator 20 and an impedance matching circuit 21 by a terminal 50 on the anode element 14. The cathode element 16 of the RF applicator may be electrically coupled to the RF generator 20 and an impedance matching circuit 21 by one or more terminals 52, 53, 55 of the cathode element 16. The cathode terminals 52, 53, 55 and their connection to the RF generator 20 and impedance matching circuit 21 may be additionally connected to an electrical ground 54. In this way, the RF generator 20 may apply an RF signal of a desired power level and frequency to energize the RF applicator 12 by supplying the RF signal to the portion of the anode passing through the gap in the cathode element 16. One such example of an RF signal generated by the RF applicator 12 may be 13.56 MHz. The radio frequency 13.56 MHz is one frequency in the band of frequencies between 13.553 MHz and 13.567 MHz, which is often referred to as the 13.56 MHz band. The band of frequencies between 13.553 MHz and 13.567 MHz is one of several bands that make up the industrial, scientific and medical (ISM) radio bands. The generation of another RF signal, or varying RF signals, particularly in the ISM radio bands, is envisioned.

The impedance matching circuit 21, by electrically coupling the RF generator 20 and the RF applicator 12 to each other, may provide a circuit for automatically adjusting the input impedance of the electrical load to maximize power transfer from the RF generator 20 to the RF applicator 12, where the electrical load is substantially determined by the wet textiles and the anode and cathode elements 14, 16. There are a number of well-known impedance matching circuits for RF applications including L-type, Pi-type, and T-type networks of which any may be implemented without limitation in an embodiment of the invention.

The aforementioned structure of the RF laundry dryer 10 operates by creating a capacitive coupling between the pluralities of digits 32, 40 and 34, 46 of the anode element 14 and the cathode element 16, at least partially spaced from each other. During drying operations, wet textiles to be dried may be placed on the drying surface 22. During, for instance, a predetermined cycle of operation, the RF applicator 12 may be continuously or intermittently energized to generate an e-field between the capacitive coupling of the anode and cathode digits which interacts with liquid in the textiles. The liquid residing within the e-field will be dielectrically heated to effect a drying of the laundry.

During the drying process, water in the wet laundry may become heated to the point of evaporation. As water is heated and evaporates from the wet laundry, the impedance of the electrical load; that is the impedance of the laundry and the RF applicator 12, may vary with respect to time as the physical characteristics of laundry load change. As previously described, the impedance matching circuit 21 may adjust the impedance of the electrical load to match the impedance of the RF generator 20 which typically holds at a steady value such as 50 Ohms. Also, as previously described, impedance matching may provide efficient transfer of power from the RF generator 20 to the RF applicator 12. To aid in the maximum power transfer of the power from the RF generator 20 to the RF applicator, the e-field must be formed between the anode and cathode elements 14, 16. Significantly, the anode element 14 should be shielded from the Faraday cage 26 to prevent unwanted electromagnetic leakage where some amount of the e-field is formed between the anode element 14 and the Faraday cage 26.

Figure 4:
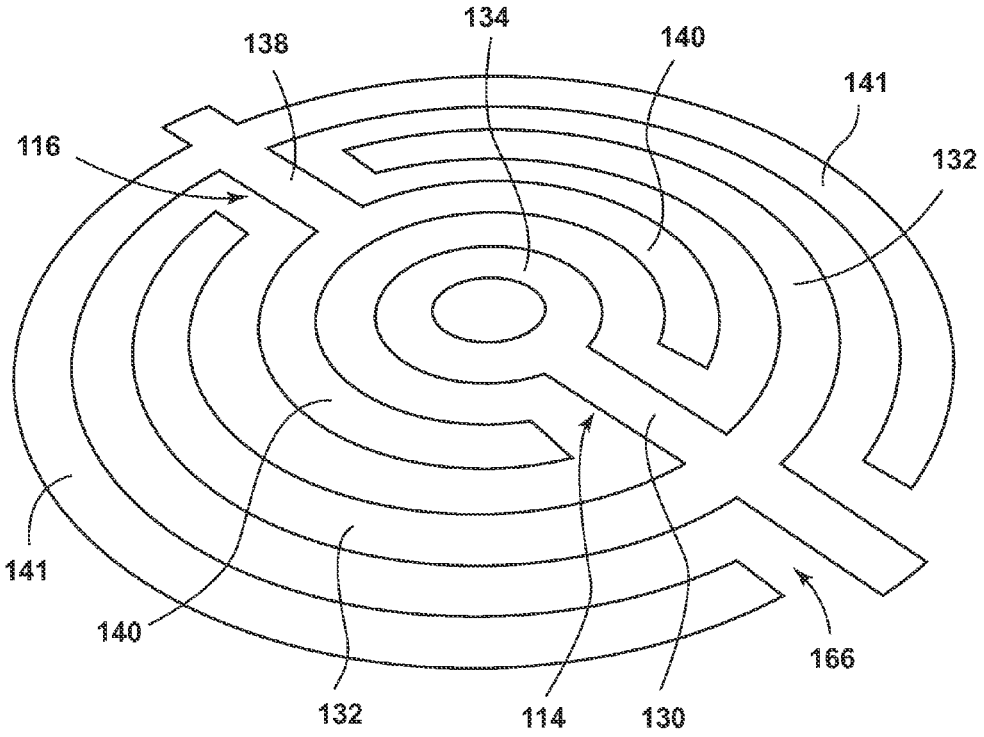
FIG. 4 is a schematic perspective view of an alternative configuration of the anode and cathode elements of the RF applicator.
Figure 5:
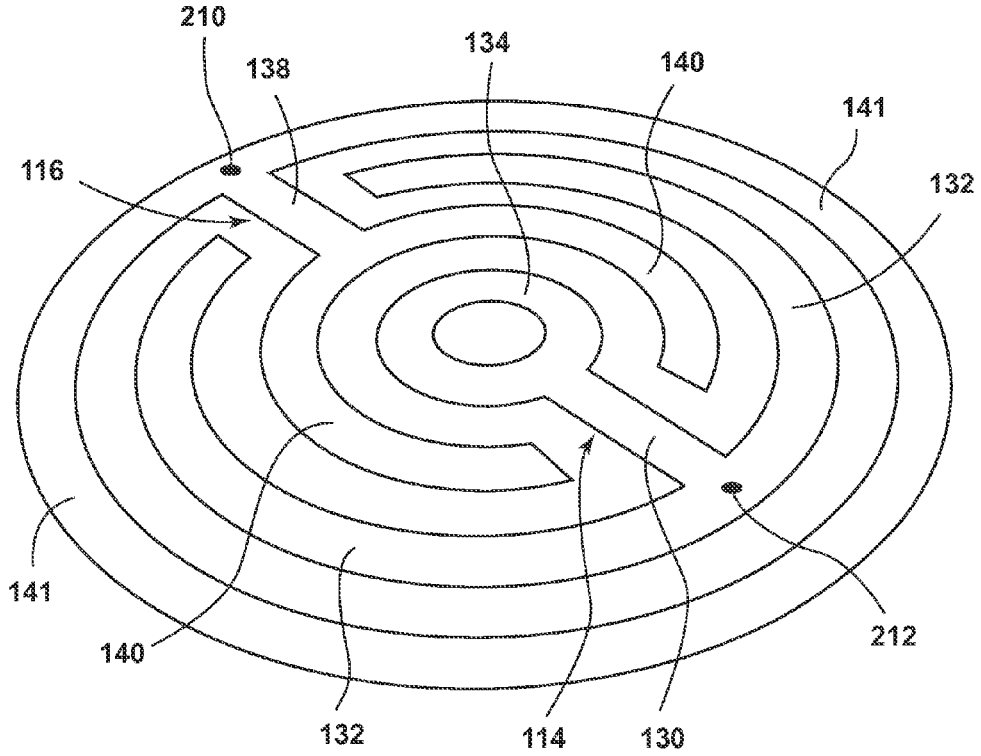
FIG. 5 is a schematic perspective view of an yet another alternative configuration of the anode and cathode elements of the RF applicator.

FIG. 4 illustrates an alternative configuration of the anode and cathode elements 114, 116 of the RF applicator 12. The alternative configuration of anode and cathode elements 114, 116 may be similar to the anode and cathode elements 14, 16 described above; therefore, like parts will be identified with like numerals beginning with 100, with it being understood that the description of the like parts applies to the alternative configuration of anode and cathode elements, unless otherwise noted. The anode element 114 is a circular tree structure where the digits 132 follow an arcuate path. As shown in FIG. 4, the arcuate path is substantially circular though other paths such as elliptical may be implemented. As with the linear tree structure, the trunk 130 of the anode element 114 may pass through a space 166 formed at the gap of cathode digits 141. The interior digit 134 of the anode element 114 may be formed as a substantially complete circle or ellipse. Alternatively, the space 166 formed at the gap of cathode digits 141 may be completely eliminated as shown in FIG. 5. In this way, the circular tree structure of the anode element may be completely enclosed by one or more digits of the cathode element 116.

Cathode and anode connections 210, 212 respectively, may be provided along any of the digits of cathode and anode elements 116, 114. For example, as shown in FIG. 5, the cathode connection 210 lies along the outer digit 141 and the anode connection 212 lies along the outer digit 132 at the antipode of the cathode connection 210. Similar to the anode and cathode configuration of FIG. 4, the arcuate path of the anode and cathode elements is substantially circular though other paths such as elliptical may be implemented. Other arrangements of the digits, trunk elements and terminals of the anode may be implemented. For example, the digits of either the first plurality or second plurality of digits 32, 34 may not be perpendicular to the trunk element 30. The digits of either the first plurality or the second plurality of digits 32, 34 may not intersect the trunk element 30 at the same angle or location. Many alternative configurations may be implemented to form the plurality of digits, the trunk elements and the interconnections between the trunk elements and the digits of the anode and cathode elements. For example, one embodiment of the invention contemplates different geometric shapes for the textile treating appliance 10, such as substantially longer, rectangular appliance 10 where the anode and cathode elements 14, 16 are elongated along the length of the RF laundry dryer 10, or the longer appliance 10 includes a plurality of anode and cathode element 14, 16 sets.

Additionally, the design of the anode and cathode may be controlled to allow for individual energizing of particular RF applicators in a single or multi-applicator embodiment. The effect of individual energization of particular RF applicators results in avoiding anode/cathode pairs that would result in no additional material drying (if energized), reducing the unwanted impedance of additional anode/cathode pairs and electromagnetic fields, and an overall reduction to energy costs of a drying cycle of operation due to increased efficiencies. Also, allowing for higher power on a particular RF applicator with wet material while reducing power on an RF applicator with drier material may result in a reduction of plate voltage and, consequently, a lower chance of arcing for an RF applicator.

For purposes of this disclosure, it is useful to note that microwave frequencies are typically applied for cooking food items. However, their high frequency and resulting greater dielectric heating effect make microwave frequencies undesirable for drying laundry articles. Radio frequencies and their corresponding lower dielectric heating effect are typically used for drying of textiles. In contrast with a conventional microwave heating appliance, where microwaves generated by a magnetron are directed into a resonant cavity by a waveguide, the RF applicator 12 induces a controlled electromagnetic field between the anode and cathode elements 14, 16. Stray-field or through-field electromagnetic heating; that is, dielectric heating by placing wet articles near or between energized applicator elements, provides a relatively deterministic application of power as opposed to conventional microwave heating technologies where the microwave energy is randomly distributed (by way of a stirrer and/or rotation of the load). Consequently, conventional microwave technologies may result in thermal runaway effects that are not easily mitigated when applied to certain loads (such as metal zippers, etc). Stated another way, using a water analogy where water is analogous to the electromagnetic radiation, a microwave acts as a sprinkler while the above-described RF applicator 12 is a wave pool. It is understood that the differences between microwave ovens and RF dryers arise from the differences between the implementation structures of applicator vs. magnetron/waveguide, which renders much of the microwave solutions inapplicable for RF dryers.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A radio frequency (RF) clothes dryer comprising:

an RF generator;

an RF applicator having a coplanar anode and a cathode, the anode having a trunk from which multiple digits branch, the anode trunk having a first terminal electrically coupled to the RF generator, and the cathode having a trunk from which multiple digits branch, the cathode trunk having a second terminal and a third terminal, the second and third terminals electrically coupled to the RF generator;

a drying surface on which textiles are supported for drying, located relative to the RF applicator such that the drying surface lies within an e-field generated by the RF applicator; and a Faraday cage enclosing the drying surface;

wherein the cathode encompasses the anode multiple digits, except for a space in the cathode defined by a gap in the cathode trunk through which the anode trunk extends to connect to the first terminal, to electrically shield the anode from the Faraday cage ensuring formation of an e-field between the anode and cathode instead of between the anode and the Faraday cage upon energizing the RF generator, wherein at least some of the anode multiple digits and the cathode multiple digits are interdigitated, and wherein the second and third terminals are at the gap.

2. The RF clothes dryer of claim 1 wherein the anode is spaced closer to the cathode than to the Faraday cage.

3. The RF clothes dryer of claim 1 wherein at least one of the digits of the cathode encompasses the anode digits.

4. The RF clothes dryer of claim 1 wherein the first terminal is electrically coupled to the RF generator and the second and third terminals are electrically coupled to ground.

5. The RF clothes dryer of claim 4 further comprising an impedance matching circuit electrically coupling the RF generator and the RE applicator.

6. The RF clothes dryer of claim 1 wherein the anode defines at least one of a linear tree structure or a circular tree structure.

7. The RF clothes dryer of claim 1 wherein the drying surface is a planar surface.

8. The RF clothes dryer of claim 7 wherein the planar surface is vertically spaced from the Faraday cage.

* * * * *